US008403596B2

(12) United States Patent
Schafer et al.

(10) Patent No.: US 8,403,596 B2
(45) **Date of Patent: *Mar. 26, 2013**

(54) GROUNDWATER CONTROL SYSTEM AND METHOD

(75) Inventors: Charlie J. Schafer, Panora, IA (US); Britt Dinsdale, West Des Moines, IA (US); William Littler, IV, Adair, IA (US); Phil Algreen, Earlham, IA (US)

(73) Assignee: Charles J. Schafer, Panora, IA (US)

( * ) Notice: Subject to any disclaimer, the term of this patent is extended or adjusted under 35 U.S.C. 154(b) by 1264 days.

This patent is subject to a terminal disclaimer.

(21) Appl. No.: 10/881,082

(22) Filed: Jun. 30, 2004

(65) Prior Publication Data

US 2006/0002763 A1 Jan. 5, 2006

(51) Int. Cl.
*E02B 11/00* (2006.01)

(52) U.S. Cl. ..... 405/37; 405/51; 137/624.11

(58) Field of Classification Search ..... 405/37; 137/624.11, 624.18; 239/70
See application file for complete search history.

(56) References Cited

U.S. PATENT DOCUMENTS 5,323,317 A * 6/1994 Hampton et al. ..... 702/3
5,342,144 A * 8/1994 McCarthy ..... 405/39
6,715,508 B2 4/2004 Schafer ..... 137/624.18

* cited by examiner

*Primary Examiner* — Tara M. Pinnock
(74) *Attorney, Agent, or Firm* — G. Brian Pingel; Camille L. Urban; David M. Breiner

(57) ABSTRACT

A groundwater control system and method for regulating the level of groundwater in an agricultural field according to selected criteria including a drainage tile line having a water flow regulator that is computer controlled through a communications link in response to the selected criteria to provide a water table profile for the field.

11 Claims, 4 Drawing Sheets

GROUNDWATER CONTROL SYSTEM AND METHOD

BACKGROUND OF THE INVENTION

1. Field of the Invention

The present invention relates in general to regulating the level of groundwater in the fields of an agricultural operation and, more particularly, wherein the level of the groundwater in the field is regulated according to a predetermined water table profile for improved crop yields and retention of resources and nutrients.

2. Description of the Prior Art

It is known in the art to use a variety of machines and apparatuses to increase or decrease moisture in the soil used for agrarian purposes. Some of these machines include the use of aquifers, irrigation ditches and canals, use of overhead sprinkler irrigation, terracing for directing the flow of water while maintaining top soil and some moisture in the soil on a hill, and the laying of underground tile lines into which water will drain and flow away from the field.

Tile lines, while effectively routing excess water from the soil have heretofore typically served that singular purpose. Unfortunately, when moisture levels in the season result in a need for more water in the soil, the tile lines typically continue to drain without means to control or adjust the flow. In this manner, efficient water removal by the lines can be detrimental to the crop either by depriving the plants of moisture or by allowing nitrates, phosphates and other nutrients used by plants to flow out of the soil before sufficient time has passed to allow them to break down naturally.

As an improvement over uncontrolled tile lines, drainage systems have been developed that include the use of flow control regulators in the lines in such a way as to manage and regulate the moisture level in the soil. The management is typically based upon seasonal needs and is provided via automatic adjustments of the flow control regulators according to a twelve-month calendar through the use of electric motors that are adapted to open or close flow gates in the flow control regulators and timers that determine the operation of the motors. This type of groundwater control system is described in United States patent to Schafer et al., No. U.S. Pat. No. 6,715,508 B2 issued Apr. 6, 2004 and U.S. patent application Ser. No. 10/758,507 in the name of Schafer et al.

Although water drainage systems that include timer control regulators are a vast improvement over uncontrolled systems, they operate in essentially the same manner regardless as to the type of weather that has occurred and the amount of groundwater in the soil. The present invention is designed to provide a groundwater control system that is preferably actuated in response to a sensing of the groundwater level in the soil to produce a desired groundwater level profile, but the system may also be based on weather forecasts or other conditions that could affect the level of groundwater in the field.

SUMMARY OF THE INVENTION

The present invention provides a method and a system for controlling and regulating the level of groundwater in an agricultural field according to selected criteria that involves the use of a buried tile line in said field to drain water therefrom, a water flow regulator located in the tile line for controlling the flow of water therethrough, means for determining information concerning the groundwater in the field, computer processing means for providing control signals to the water flow regulator in response to information from the sensing means and communication means between said computer and said sensing means and said flow regulator.

In a preferred embodiment of the system of the present invention, the sensing means monitors the level of groundwater in the field on a periodic basis and provides output signals representative of said level information via said communication means to the computer processing means, which in turn provides control signals to the flow regulator in accordance with predetermined selected criteria programmed in the processing means.

In a preferred embodiment of the method of the present invention, the water flow regulator is controlled via programming of the computer processing means to respond to said water level output signals from said sensing means according to the selected criteria. In this way, the water flow regulator gate is positioned to produce a water table profile over a selected period of time.

The foregoing and other advantages of the present invention will appear from the following description. In the description, reference is made to the accompanying drawings, which form a part hereof, and in which there is shown by illustration and not of limitation a specific system and method in which the invention may be embodied. Such embodiments do not represent the full scope of the invention, but rather the invention may be employed in a variety of other embodiments and reference is made to the claims herein for interpreting the breadth of the invention.

DETAILED DESCRIPTION OF THE PREFERRED EMBODIMENT

The present invention is adapted to provide a system and method for regulating the level of groundwater in an agricultural field according to predetermined selected criteria. Consequently, the system and method of the present invention may be advantageously employed to reduce, maintain or accumulate the amount of groundwater according to seasonal needs for the planting and harvesting of crops in the field. For example, during the winter months it is desirable to keep the water table high in the soil so that nutrients, phosphates and nitrates will not be lost, but can break down naturally in the soil or be maintained until needed in the spring. In contrast, the water table should be significantly lowered prior to harvest to allow access to the field and to minimize compaction of the soil by large harvesting equipment. This is also true for the time period prior to and during planting to allow the soil to warm and encourage root growth and, again, to allow access to the field.

During times of heavy rainfall, the present invention can also be employed to reduce the amount of drainage from the field to prevent nutrients, phosphates and nitrates from being carried away by the drainage of excess water in the field.

Accordingly, the present invention is adapted to utilize available information concerning the water table level of the field and can take seasonal needs into account in doing so in order to automatically manage water drainage from the field.

Figure 1:
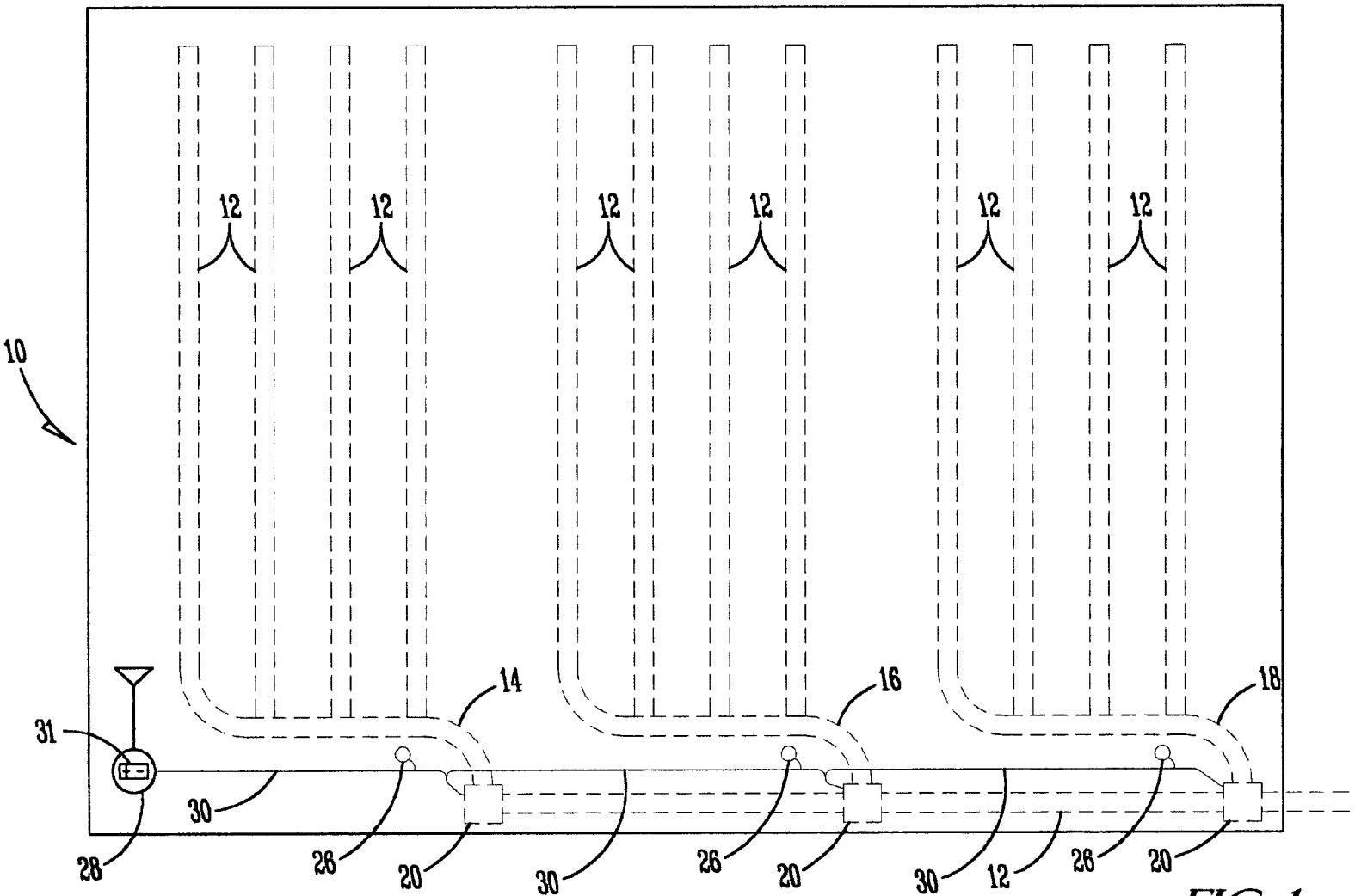
FIG. 1 is a diagrammatical view of an agricultural field having various components of a preferred embodiment of the groundwater control system of the present invention that are located in the field.

Referring now to the drawings and with reference first to FIG. 1, a diagram of an agricultural field is shown generally at 10. Although only one field 10 is illustrated in FIG. 1, it is contemplated that the system and method of the present invention can be readily employed for providing water drainage control of numerous different fields that may be separated many miles apart.

As illustrated by dotted lines in FIG. 1, the field 10 includes a plurality of buried groundwater drainage tile lines 12 that feed into three different tile line branches 14, 16 and 18 located in the field 10 in a spaced apart proximity for the purpose of draining groundwater from areas throughout the field. Each of the tile line branches 14-18 includes a tile line water flow regulator 20 that can be electrically actuated, as will be described below, to control the flow of water through its respective tile line branch 14-18. The regulators 20 are preferably buried sufficiently deep in the field 10 so that field tilling operations can be accomplished without resort to them.

Each of the water flow regulators 20 is associated with a sensing means preferably provided by a water pressure sensor 26 that is designed to periodically monitor the level of groundwater in that portion of the field 10 proximate thereto and to provide output signals representative of such groundwater levels. The sensors 26 preferably are in the form of transducers/transmitters that are buried in the ground in a close proximity to their associated flow regulator 20.

The sensors 26 are in communication with their respective regulator 20, preferably by means of buried cables 30 that also electrically connect the regulators 20 to a transceiver 28. The output signals indicative of the water levels in the proximity of the sensors 26 are first supplied to the regulators 20 and, then in turn, are relayed on to the transceiver 28, which is also designed to receive flow control signals for supply to the flow control regulators 20. The transceiver 28 and flow controllers 20 are in the form of remote terminal units having a repeater capability to allow them to communicate with similar type equipment. Preferably, the transceiver 28 and regulators 20 are powered by a battery supply 31, solar panels or power lines.

Figure 2:
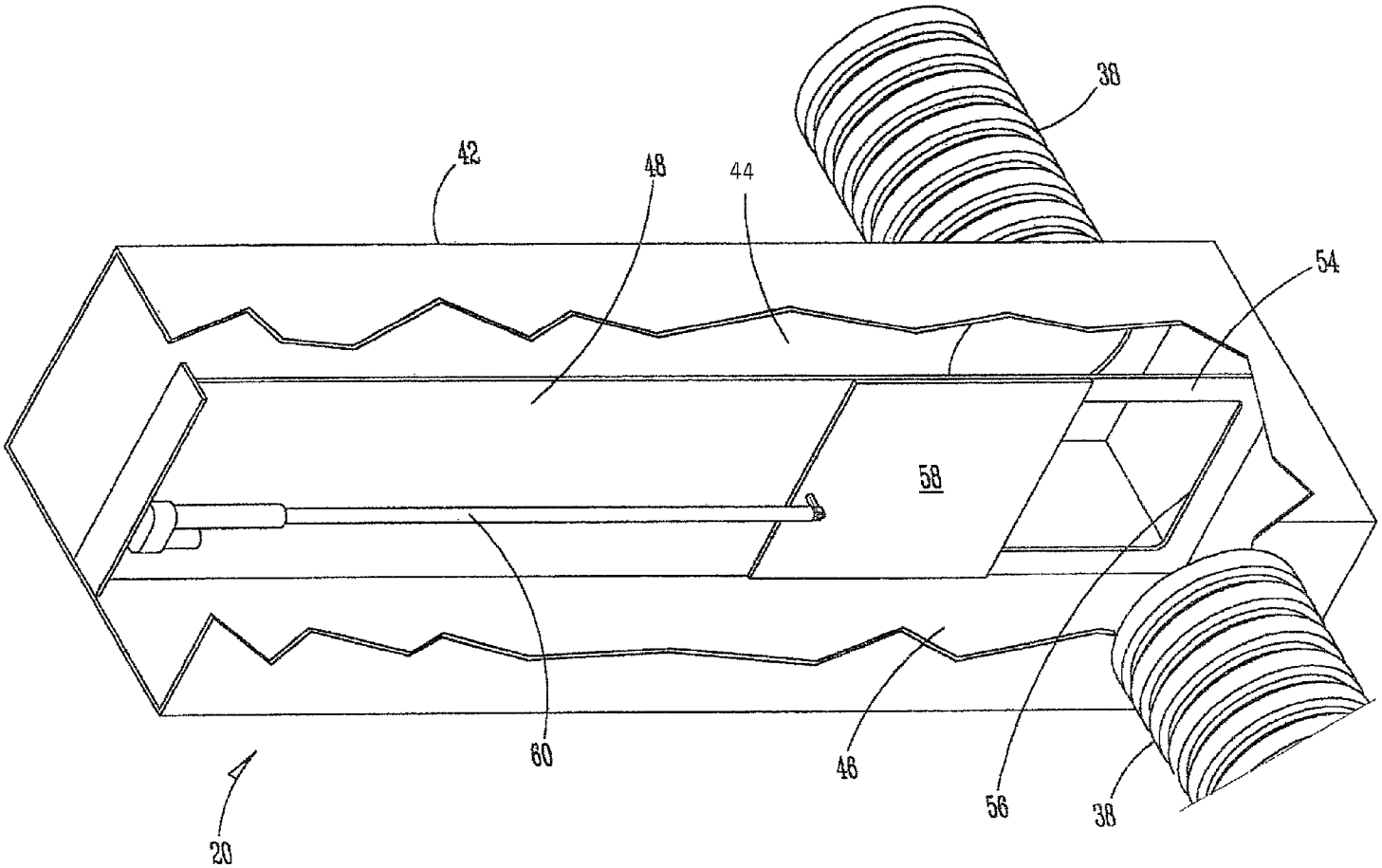
FIG. 2 is a perspective view of a water flow regulator that is part of the preferred embodiment of the system of the present invention.

Referring now to FIG. 2, a perspective view of one of the flow regulators 20 is shown in combination with conduit portions 38 of the tile line 12. As seen in FIG. 2, each of the flow regulators 20 includes a rectangularly shaped box-type housing 42 that is divided into a front portion 44 and a back portion 46 by a partition 48 running the length of the housing 42. One side end 54 of the partition 48 includes a water flow aperture 56 that allows water to flow from the housing front portion 44 to the back portion 46 when it is unblocked.

Associated with the aperture 56 is a slidable gate 58, the position of which is controlled by a variable linear actuator 60 to open or close the aperture 56 in varying degrees to regulate the flow of water through the housing 42. Preferably, a position transducer pulse generator such as a potentiometer, as is well-known in the art, will be associated with the actuator 60 so that electronic signals representative of the position of the gate 60 can be supplied to the transceiver 28 to verify that the gate 58 is in a proper position.

Figure 3:
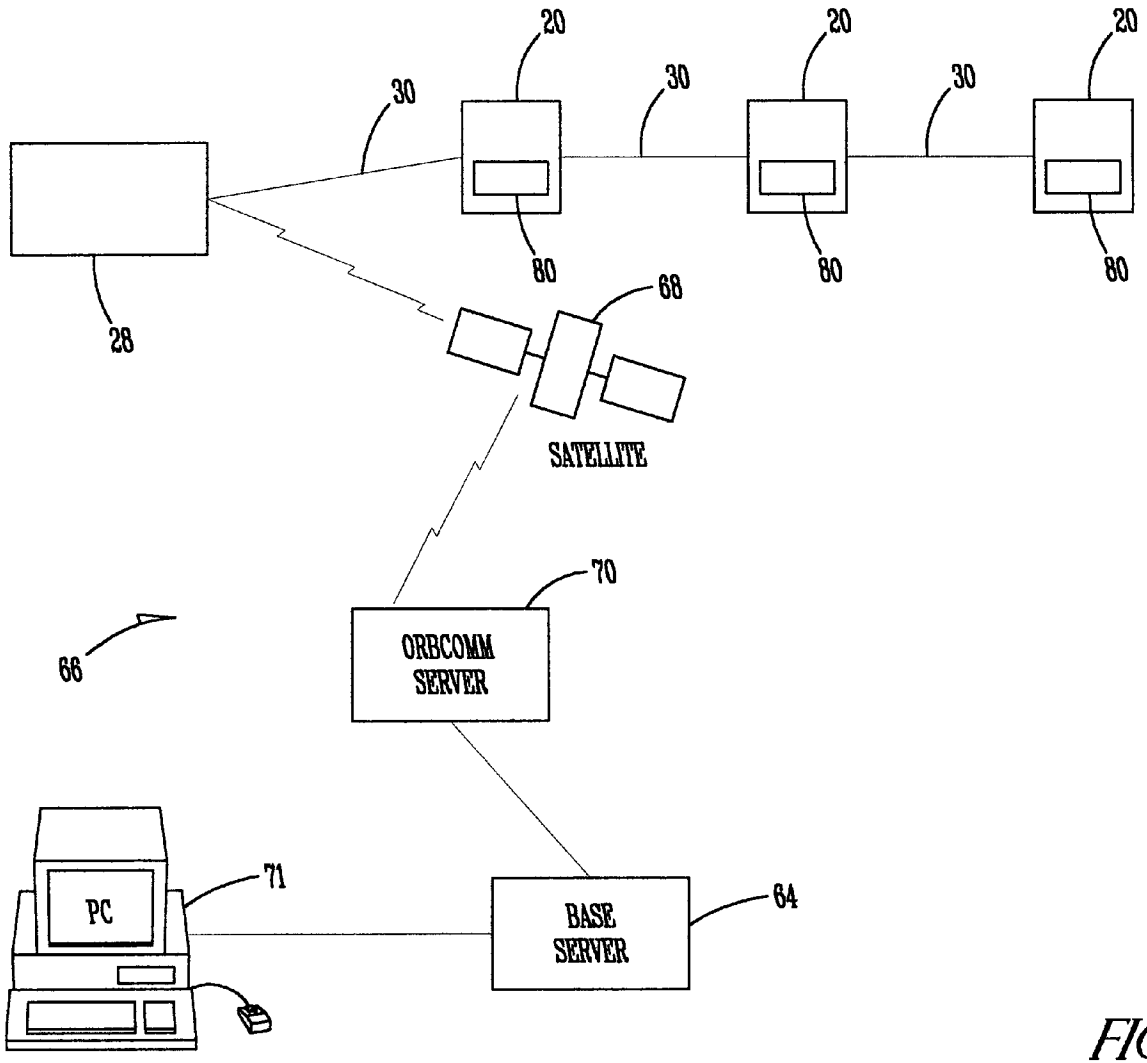
FIG. 3 is a diagrammatic view of a communications network that is included in the preferred embodiment of the water control system of the present invention.

It is contemplated that the field 10 will require only one transceiver 28 that, as shown in FIG. 3, will be in communication with the regulators 20 included in a particular system. Such communication is preferably provided by the buried cables 30 so that use of the system of the present invention does not increase the number of obstacles in the field 10 that must be avoided during tilling operation. However, it is contemplated that the regulators 20 could employ an antenna for providing wireless communication with the transceivers 28 if that is desired.

The representation of FIG. 3 is designed to cover an entire field, with the use of only one of the transceivers 28. Preferably, because of their repeater capability the regulators 20 will be able to communicate with one another to increase the distance of viable communication between the transceiver 28 and the regulator 20 most remote therefrom.

The information signals received and transmitted by the transceiver 28 are communicated to a base computer server 64, as indicated in FIG. 3, by an appropriate communications link, which in the preferred embodiment is a satellite link indicated generally at 66. Accordingly, the transceiver 28 communicates with an orbiting satellite 68, which in turn is in connection with an orbital communications server 70 that relays information between the satellite 68 and the base computer server 64.

If the system of the present invention is designed to be utilized by a company that provides water regulation services to a variety of clients, the base server 64 will also be in communication via the Internet with a plurality of personal computers of its various clients, only one of which is shown in FIG. 3 as 71. However, if an agricultural producer is operating the water control system of the present invention on his own, the orbital communications server 70 will communicate directly with the personal computer 71.

The base server 64 is preferably programmed with data base information concerning the characteristics of the field 10 as well as the operational program for controlling the positions of the regulator gates 58 to provide a desired water table profile on preferably an annual basis. Such a profile is exemplified by graph 72 shown in FIG. 4, which is adapted for use with the field 10 being located in the Midwestern United States.

It should be recognized by those skilled in the art that rather than utilizing the computer server 64 for controlling operation of the regulator gates 58, the regulators 20 themselves could include a computer processing unit 80 that would receive the water level signals from the sensors 26 and control the operation of the regulators 20 in response thereto. In such configuration, communication with the base server 64 would not be absolutely essential, but it would be highly preferably so that the operational programs for each CPU 80 could be readily modified as desired.

Figure 4:
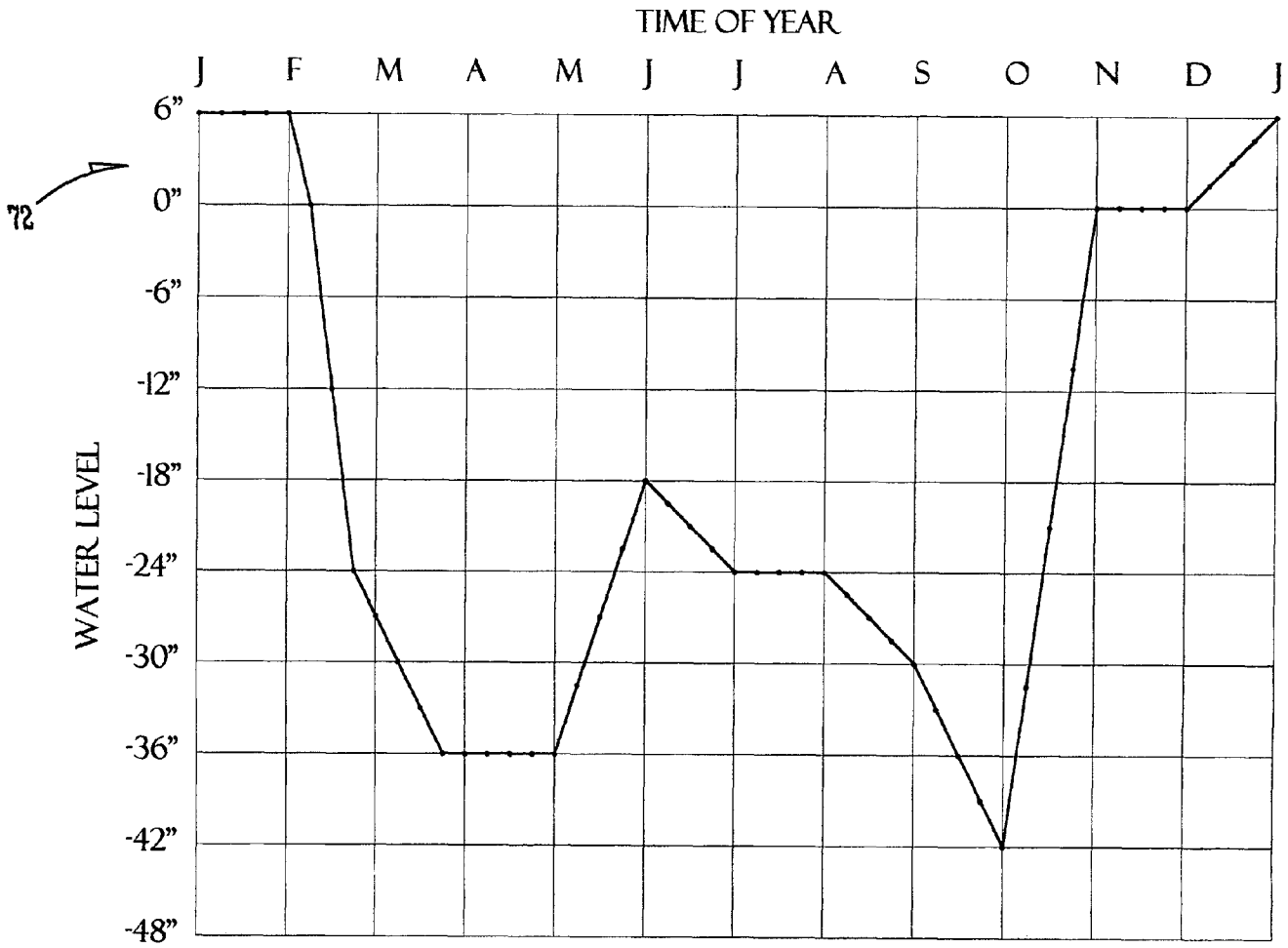
FIG. 4 is a graph of a typical type of annual groundwater level profile for the field of FIG. 1.

As indicated by the graph of FIG. 4, during the month of January, the groundwater level is maintained at its highest level so that the system of the present invention will provide saturation to the surface or shallow flooding of the field 10 for a sufficient time to accomplish desired pest control, provide wildlife habitat, and reduce the rate of oxidation of organic soils. After the month of January, the system will begin draining water from the field 10 to take the water level down to its lowest position prior to initiation of planting to allow the soil to warm and encourage root growth and to allow access to the field. After planting has been completed and plant growth begins, the water level is increased for providing moisture for the crop and is then slowly lowered as plant growth proceeds.

Once the plants in the field 10 have reached maturity, the water level is again reduced to a minimum level prior to harvest to allow access to the field and to minimize compaction of the soil by large harvesting equipment. Following harvesting, the water level is then returned to the maximum level to begin the cycle over again in January of the next year.

It should be kept in mind that the water table profile of FIG. 4 is only exemplary of the type of profiles that can be maintained by the system of the present invention. Accordingly, the base server 64 will be programmed to provide for different types of water table profiles depending upon the particular characteristics of the field 10 with which the system will be used and the type of crops and specific weather conditions occurring during any particular year.

Thus, the present invention provides a novel and unique means for regulating the level of groundwater in an agricultural field according to selected criteria. Although the control system and method of the present invention has been described with respect to a preferred embodiment, it should be understood that such embodiment may be altered without avoiding the true spirit and scope of the present invention. For example, a wide variety of communication links can be substituted for the satellite link 66, and a variety of different types of regulators 20 can be employed so long as it is possible to bury them deep enough in the field 10 so that they do not disrupt crop related activities. Also, rather than basing system operation on the sensing of the groundwater level, such operation may involve other types of sensing that provides information concerning the amount of groundwater present, rather than the actual level itself.

It should also be recognized by those skilled in the art that although the present invention is particularly adapted for providing a preferred water table profile, in times of unusual weather activities, the system can be controlled to compensate for unusually dry or wet conditions. For example, during a period of heavy rainfall, the regulators 20 can be directed to a fully closed condition to temporarily block water flow through the tile line 12 to prevent excess water drainage from the field following the application of fertilizers or pesticides to the field to prevent the runoff thereof. Conversely, the regulators 20 can be directed to a fully opened condition to drain excess water from the field, if desired during heavy rainfall.

What is claimed is:

1. A groundwater control system for an agricultural field to regulate the level of groundwater in said field according to selected criteria, said system comprising:

(a) a buried field drainage tile line extending underground in said field to serve to drain water therefrom;

(b) a water flow regulator located in said tile line and having a movable gate that is powered to control the flow of water therethrough;

(c) means located in-ground, and exterior to said tile line and said water flow regulator, for sensing the amount of groundwater in said field before the groundwater enters said tile line on at least a periodic basis and for providing output signals representative of said groundwater information, said means for sensing is located exterior of both said drainage tile line and said regulator;

(d) processing means programmed with the selected criteria for said groundwater level for receiving said output signals representative of said groundwater information and providing output signals to said flow regulator to control the position of said gate for meeting said selected criteria; and (e) a communication link linking said processing means, said means for sensing the amount of groundwater, and said flow regulator, said link comprising satellite receiving and transmitting means.

2. The control system as described in claim 1 wherein said tile line, said regulator and said sensing means are buried in said field at a depth sufficient to allow said field to be tilled without resort to the location of said line, said regulator or said sensing means.

3. The control system as described in claim 1, wherein said processing means is located in said field.

4. The control system as described in claim 1, wherein said processing means is physically associated with said regulator.

5. The control system as described in claim 1, wherein said processing means is at a distant location to said field.

6. The control system as described in claim 5, wherein the preprogramming of said processing means is associated with field information provided to said processing means.

7. The control system as described in claim 6, wherein said communication link includes a transceiver located in said field.

8. The control system as described in claim 7, wherein said sensing means and said flow regulator are electronically connected to said transceiver by electrical conductors.

9. A groundwater control system for a plurality of agricultural fields to regulate the level of groundwater in said fields according to selected criteria, said system comprising:

(a) a buried field drainage tile line extending underground in each of said fields to serve to drain water therefrom;

(b) a water flow regulator located in each of said tile lines and having a moveable gate that is powered to control the flow of water therethrough;

(c) means buried in each of said fields and located exterior of said flow regulator and said tile lines for sensing the amount of groundwater in each of said fields before the groundwater enters said tile line on at least a periodic basis and for providing output signals representative of said groundwater information;

(d) processing means for receiving said groundwater information and providing output signals to said flow regulators to control the position of said gates for meeting said selected criteria;

(e) means for serving as a communication link between said processing means and said sensing means and said flow regulators;

(f) power source means for providing electrical power for said regulators; and (g) said communication link mean including:

(1) a field transceiver for each of said fields for receiving output signals from said sensing means and providing gate control signals to said regulators;

(2) a base unit in communication with each of said field transceivers;

(3) a satellite communication link between said base unit and said processing means.

10. The control system as described in claim 9, wherein said processing means is preprogrammed with the selected criteria for said groundwater levels of each of said fields.

11. The control system as described in claim 10, wherein said tile lines, said regulators, and said sensing means are buried in said fields at depths sufficient to allow said fields to be tilled without resort to the location of said lines, said regulators, or said sensing means.

* * * * *